United States Patent [19]

Le Devehat

[11] Patent Number: 5,035,256

[45] Date of Patent: Jul. 30, 1991

[54] TWO-WAY VALVE FOR FITTING TO THE DOWNSTREAM END OF A FLUID DISTRIBUTION PIPE ADAPTED TO BE CLEANED BY SCRAPING

[75] Inventor: Eugene Le Devehat, Saligny, France

[73] Assignee: FMC Corporation, Chicago, Ill.

[21] Appl. No.: 453,723

[22] Filed: Dec. 20, 1989

[30] Foreign Application Priority Data

Dec. 20, 1988 [FR] France ..... 88 16845

[51] Int. Cl.[5] ..... B08B 9/04

[52] U.S. Cl. ..... 137/242; 15/3.51; 15/104.062; 222/148

[58] Field of Search ..... 15/3.5, 3.51, 104.062; 137/242, 244, 263, 883, 561 R; 222/148

[56] References Cited

U.S. PATENT DOCUMENTS

| | | | |
|---|---|---|---|
| 1,049,012 | 12/1912 | Weber et al. | 15/3.51 |
| 2,085,453 | 6/1937 | Schaer | 15/3.51 |
| 2,095,823 | 10/1937 | Marshall | 15/3.51 |
| 2,177,429 | 10/1939 | Foster | 15/3.51 |
| 2,948,143 | 8/1960 | Pruitt | 15/3.51 |
| 3,228,611 | 1/1966 | Russell | 15/3.5 |
| 3,266,076 | 8/1966 | Surber | 15/104.062 |
| 3,340,889 | 9/1967 | Petzhold | 137/268 |
| 3,562,014 | 2/1971 | Childers et al. | 15/104.062 |
| 4,049,018 | 9/1977 | Skibowski | 137/561 |
| 4,279,266 | 7/1981 | Knox et al. | 137/68 |
| 4,574,830 | 3/1986 | Rickey et al. | 15/3.51 |

FOREIGN PATENT DOCUMENTS

| | | |
|---|---|---|
| 1591738 | 6/1970 | France . |
| 2222587 | 10/1974 | France . |
| 2227491 | 11/1974 | France . |

*Primary Examiner*—George L. Walton

*Attorney, Agent, or Firm*—W. William Ritt, Jr.; Richard B. Megley

[57] ABSTRACT

A two-way valve apparatus for a fluid distribution pipe adapted to be cleaned by scraping, comprising a ported tube containing a mobile abutment member for receiving a scraper, and a sleeve and a tubular confinement member fastened to and moving axially in unison with the abutment member to open and close the tube port.

8 Claims, 9 Drawing Sheets

TWO-WAY VALVE FOR FITTING TO THE DOWNSTREAM END OF A FLUID DISTRIBUTION PIPE ADAPTED TO BE CLEANED BY SCRAPING

The invention concerns a two-way valve designed to be fitted to the downstream end of a liquid distribution pipe, at the free end of a vertical tube such as a vertical tube for discharging a liquid such as oil or petroleum products into a storage tank or tanker vehicle.

If the same pipe is used to distribute several liquids in succession and it is required to change liquid, after shutting off the supply of the first liquid at the upstream end of the pipe and before establishing the supply of the next liquid, also at the upstream end of the pipe, it is known practice to circulate in the pipe from the upstream end to the downstream end and vice versa a "captive" scraper to sweep the interior wall of the pipe and discharge residues of the first liquid adhering to this internal wall to the downstream end before returning to its point of departure. This prevents partial mixing between the successive liquids.

The scrapers are "captive" in the sense that they are prevented from escaping from the pipe; it is therefore necessary to provide in the valves downstream of the pipe an abutment for the scraper adapted to enable flow of the liquid while preventing the scraper being entrained in said liquid.

One example of a two-way valve of this kind designed to be mounted at the downstream end of a liquid distribution pipe is described in the French Patent Number 2.222.587 which provides for the fluid to flow around the periphery of an abutment placed on the path of the scraper; a cylindrical sleeve coaxial with the flow of the liquid is slidably mounted on the abutment so that by varying the axial position of the sleeve the passage whereby the liquid flows around the abutment is either closed off or opened.

In known solutions the position of the sliding sleeve is commanded (or maintained) independently of the presence of liquid pressure on the downstream side of the valve.

Also, in the aforementioned French Patent Number 2.222.587 the pressure needed to return a scraper abutting against the abutment in the upstream direction is applied in the passage in which the liquid flows near the abutment.

Finally, this known solution is not well suited to enabling fluid to flow when a scraper is present against the abutment.

The invention is directed to overcoming the aforemented disadvantages by rendering the previously fixed abutment mobile and by slaving the sliding obturator sleeve to the mobile abutment this makes it possible to implement a safety feature whereby, as appropriate to individual requirements, the valve tends to be held automatically open or closed when liquid pressure is applied to the mobile abutment.

To this end the invention proposes a two-way valve for a liquid distribution pipe adapted to be cleaned by scraping comprising a vertical tube containing an abutment member adapted to receive a scraper in abutting relationship against it, an annular slot in the vertical tube on the upstream side of the abutment member and a sliding obturator sleeve movable longitudinally by a control device between a closed configuration in which the sleeve shuts off the annular slot and an open configuration in which the sleeve exposes at least part of the annular slot, characterised in that the abutment member is mobile and is fastened to said sleeve, a reverse flow pressure injection orifice discharging into the abutment member.

In preferred embodiments of the invention:

when the sliding sleeve is in the configuration with the annular slot open the abutment member is farther upstream than in the closed configuration at a sufficient distance from the annular slot to enable a scraper to come into abutting relationship with it without closing off said slot, the sliding sleeve slides along the outside of the vertical tube and is fastened to a cylindrical confinement member fastened to the abutment member, the sliding sleeve is fixed along the internal wall of the cylindrical confinement member which is joined further downstream to the abutment member by radial fingers passing through longitudinal slots in the vertical tube, the cylindrical confinement member comprises upstream of the sliding sleeve an annular flange sliding in a liquid-tight way on the vertical tube which carries externally an annular collar defining in the radial direction between the cylindrical confinement member and the vertical tube and in the axial direction between the flange and the sliding tube two liquid-tight chambers adapted to have their volumes varied in opposite senses, said control device comprising respective pressurised fluid inlet/outlet orifices discharging into said chambers, said pressurised fluid inlet orifices pass through the flange and the sliding sleeve, the abutment member is cup-shaped and adapted to receive an end portion of the scraper, said reverse flow pressure injection orifice being in the bottom of said cup-shape, the sliding sleeve slides inside a tubular downstream section of the vertical tube and is formed by an extension in the upstream direction of the abutment member, the sliding tube having an inside diameter equal to the inside diameter of the upstream section of the vertical tube so as to enable a scraper to abut against the abutment member, in the configuration in which the annular slot is opened by the sliding sleeve the abutment member is farther downstream than in the closed configuration, the abutment member is extended in the dowstream direction by a tubular portion defining a channel discharging into the bottom of the abutment member and slides in a liquid-tight way in a cylindrical housing in a member fastened to the downstream tubular section of the vertical tube and communicating with said reverse flow pressure injection orifice, said control device of the sliding sleeve comprising a pressurised fluid injection orifice discharging into a chamber just downstream of the abutment member, said member fastened to the vertical tube comprises around the cylindrical housing a cylinder having at its upstream end a radially projecting flange and along which is mounted to slide in a liquid-tight way a ring extending in the radial direction as far as the downstream tubular section of the vertical tube so as to define with said member fastened to said section a second chamber into which discharges a second pressurised fluid injection orifice.

Objects, characteristics and advantages of the invention will emerge from the following description given by way of non-limiting example only with reference to the appended drawings in which:

FIGS. 1 through 5 show a first embodiment of a two-way valve 1 designed to be mounted at the downstream end of a liquid distribution pipe inside which at least one scraper can be displaced from the upstream to the downstream end and vice versa between successive different liquids.

Figure 1:
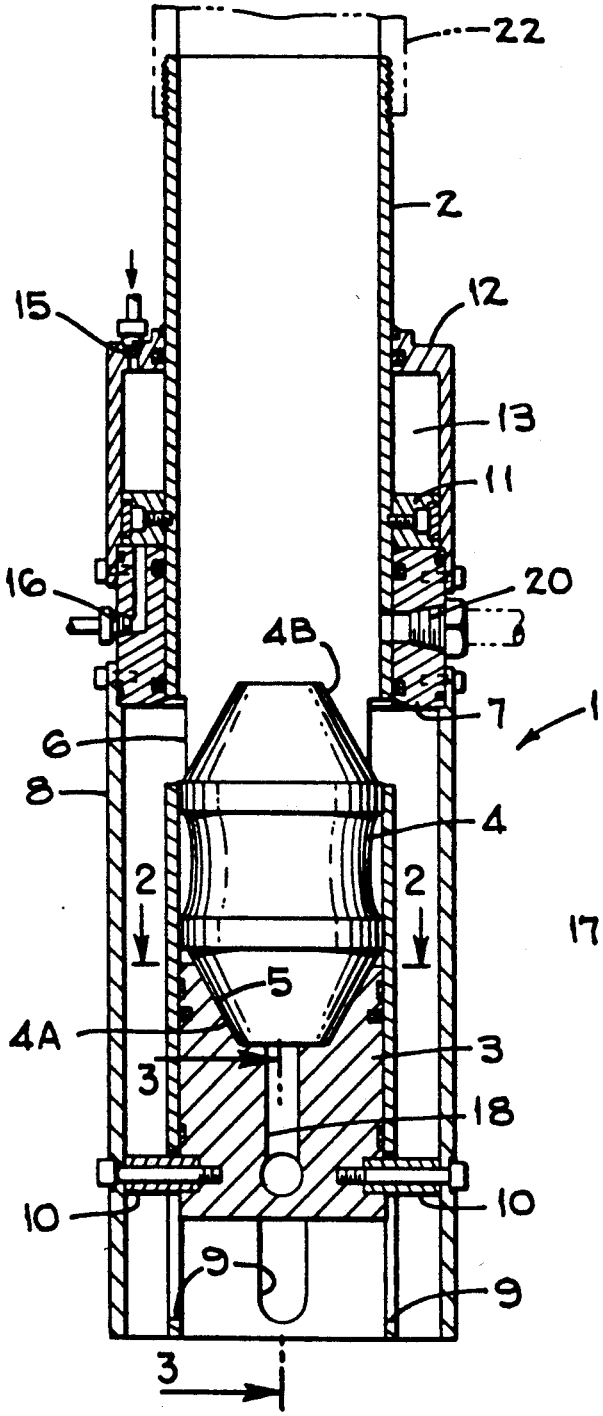
FIG. 1 is a view in axial cross-section of a two-way valve in accordance with the invention adapted to receive scrapers, shown in the open configuration.
Figure 2:
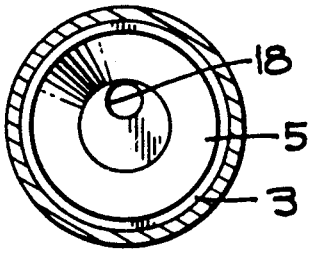
FIG. 2 is a partial view of it in transverse cross-section on the line II-II in FIG. 1.

The valve comprises a vertical tube 2 inside which is an abutment member 3 which closes off completely in a liquid-tight way the flow cross-section of the vertical tube 2 and which is adapted to receive in abutting relationship a scraper 4. The abutment member 3 advantageously comprises a cup 5 designed to mate with a complementary end part 4A of the scraper.

Upstream of the abutment member 3 is an annular slot 6, which is discontinuous in this instance, designed to enable a liquid flowing in the vertical tube to pass around the periphery of the abutment member 3. A cylindrical sleeve 7 is mounted to slide along the vertical tube so that it can selectively close off (FIG. 5) or open (FIG. 1) the discontinuous annular slot 6.

In this instance the sliding cylindrical sleeve is fastened to a cylindrical confinement member 8 which extends from the sleeve axially beyond the abutment member 3 so as to confine radially liquid flowing around the periphery of the abutment member 3.

Downstream of the discontinuous circular slot 6 are longitudinal slots 9 through which pass radial fingers 10 fastening the abutment member 3 to the cylindrical confinement member 8 and therefore to the sliding sleeve 7.

The cylindrical confinement member 8 is extended in the upstream direction around the vertical tube 2 beyond a flange 11 fastened to the outside wall of the vertical tube and adapted to constitute an abutment for the sliding cylindrical sleeve 7. This cylindrical member has at its upstream end an annular flange 12 adapted to delimit a variable volume liquid-tight annular space 13 in conjunction with the flange 11 and the walls of the vertical tube 2 and of the cylindrical member 8. Similarly the sliding sleeve 7 delimits downstream of the flange 11 an annular space 14 the axial dimension of which varies in the opposite sense to the axial dimension of the annular space 13.

Respective inlet terminations 15 and 16 on the annular flange 12 and on the sliding sleeve 7 are adapted to be connected alternately to a pressure source so that either the annular space 13 or the annular space 14 can be enlarged, as required, as in a double-acting ram.

An inlet orifice 17 also adapted to be connected to a pressure source (not shown) is provided for injecting fluid under pressure through the bottom of the cup 5 of the abutment member 3.

Figure 3:
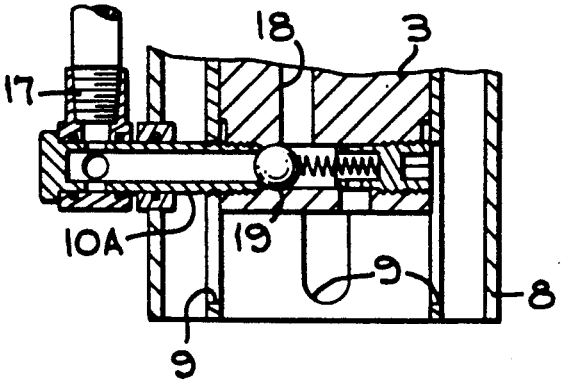
FIG. 3 is a partial view of it in axial cross-section on the line 3-3 in FIG. 1.

As shown in FIG. 3 on of the radial fingers connecting the abutment member 3 to the cylindrical confinement member 8, namely the finger 10A, is hollow to enable communication between the injection orifice 17 and an axial orifice 18 which discharges into the cup 5 of said abutment member 3.

A non-return valve 19 is provided between the injection orifice 17 and the cup 5 of said abutment member 3 to prevent any flow of liquid to the injection orifice 17.

As shown in FIG. 1 the abutment member 3 is downstream of the discontinuous annular slot 6 by a sufficient distance to enable a scraper 4 to abut against the abutment member without impeding the penetration of the flow into the discontinuous annular slot. It will be understood that in this instance the scraper 4 comprises a rear end part 4B which is frustoconical like the front end part 4A and this ensures excellent deflection of the flow towards the discontinuous annular slot.

During operation in the FIG. 1 configuration fluid pressure exists in the upstream annular space 13, having been introduced through the injection orifice 15, and as a result the combination of the abutment member 3, the cylindrical confinement member 8 and the cylindrical obturator sleeve 7 is and remains in a raised configuration: liquid flowing down along the vertical tube 2 can therefore pass without difficulty through the discontinuous annular slot 6.

If, starting from the FIG. 1 configuration, fluid pressure is injected through the orifice 16 into the annular space 14 the result is an overall downward movement of the abutment member 3, the cylindrical confinement member 8 and the sliding obturator tube 7: the discontinuous annular slot 6 is then closed and flow of liquid past the abutment member 3 is prevented. The valve 1 is then closed (FIG. 5).

In each of the configurations 1 and 5 one of the annular spaces 13 or 14 is at its maximum with the other at its minimum, that is having zero axial dimension. Relative movement between the vertical tube 2 and the mobile assembly 3+8+7 requires that the air or fluid contained in the annular space 13 or 14 which is getting smaller can escape: in the FIG. 1 configuration it can escape freely through the orifice 16 and in the FIG. 5 configuration it can escape freely through the orifice 15. This operating principle is similar to that of a double-acting ram.

Figure 4:
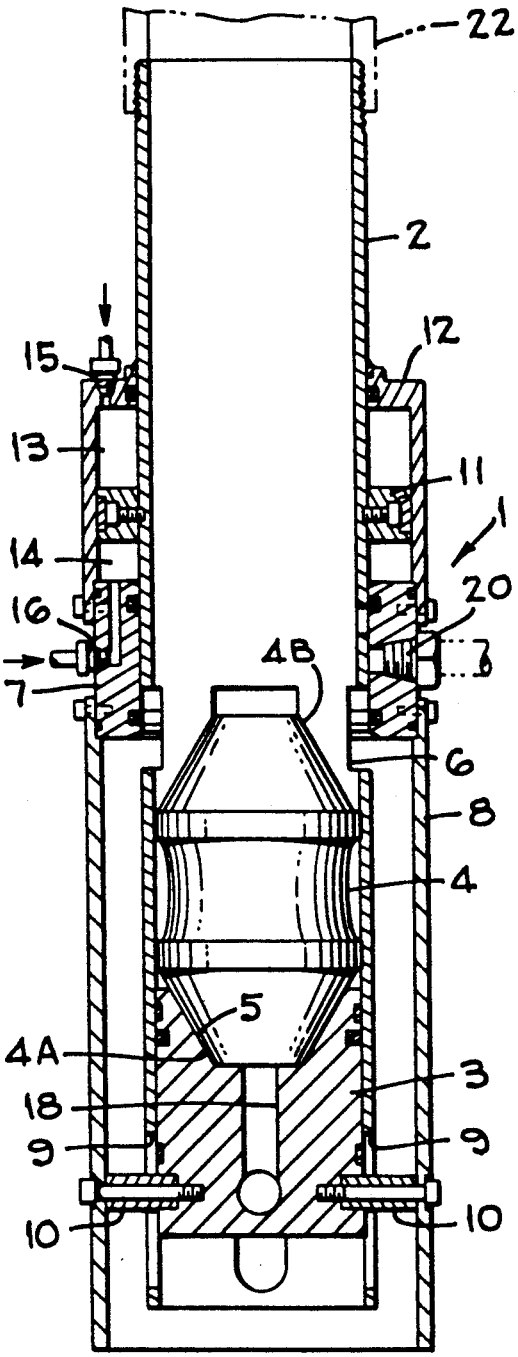
FIG. 4 is a view similar to FIG. 1 in an intermediate closing configuration.
Figure 5:
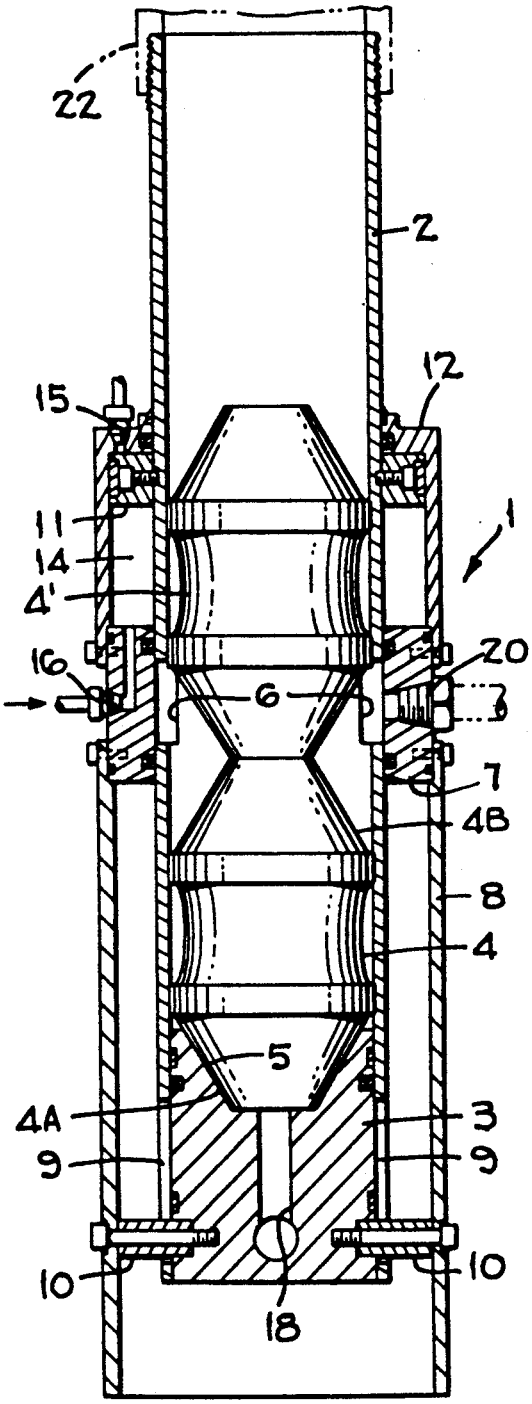
FIG. 5 is a view similar to those of FIGS. 1 and 4 in a closed configuration.

FIG. 4 corresponds to a configuration intermediate those of FIGS. 1 and 5, that is to say one in which neither of the annular spaces 13 or 14 is reduced to zero axial dimension. To achieve this a pressurised fluid such as compressed air is fed simultaneously into each of the annular spaces 13 and 14 (as shown by the arrows in FIG. 4 near the orifices 15 and 16).

As an alternative to this, it may be sufficient to inject pressurised fluid into only one annular space, the annular space 13 for example, preventing any flow of fluid to the outside of the annular space 14. In the FIG. 4 intermediate configuration the cylindrical obturator tube 7 partially closes the discontinuous annular slot 6 which enables flow around the abutment member 3 with a flowrate less than the maximum flowrate allowed by the valve 1.

It will be understood that the valve 1 shown in FIGS. 1 through 5 is of the failsafe type which automatically closes. With no pressure applied to either of the annular spaces 13 and 14 and without any form of spring return means being required a flow from top to bottom in the vertical tube 2 exerts downward pressure on the abutment member 3 which results, due only to the presence of liquid pressure upstream of the abutment member, in the members 3 and 8 moving downwards together and therefore in downward movement of the sliding obturator sleeve 7. It is therefore possible for fluid to flow only if there is an appropriate pressure in the annular space 13; any fault in the circuit supplying the annular space 13 results in the valve being closed.

In the FIG. 1 and 4 configurations a scraper 4 is butted up against the abutment member 3. At the end of flow of liquid through the vertical tube 2 and before causing a different liquid to flow the scraper 4 or a second scraper 4' (FIG. 5) is made to move through all of the pipe. To return the scraper 4 to the upstream configuration, where applicable at the same time as the scraper 4', pressurised fluid is injected through the orifice 17 into the channel 18, the effect of which is to propel the scraper or scrapers in the upstream direction.

An injection orifice 20 is preferably provided in the cylindrical obturator sleeve 7 so that the scraper 4' can be made to move in the upstream direction on its own.

Figure 6:
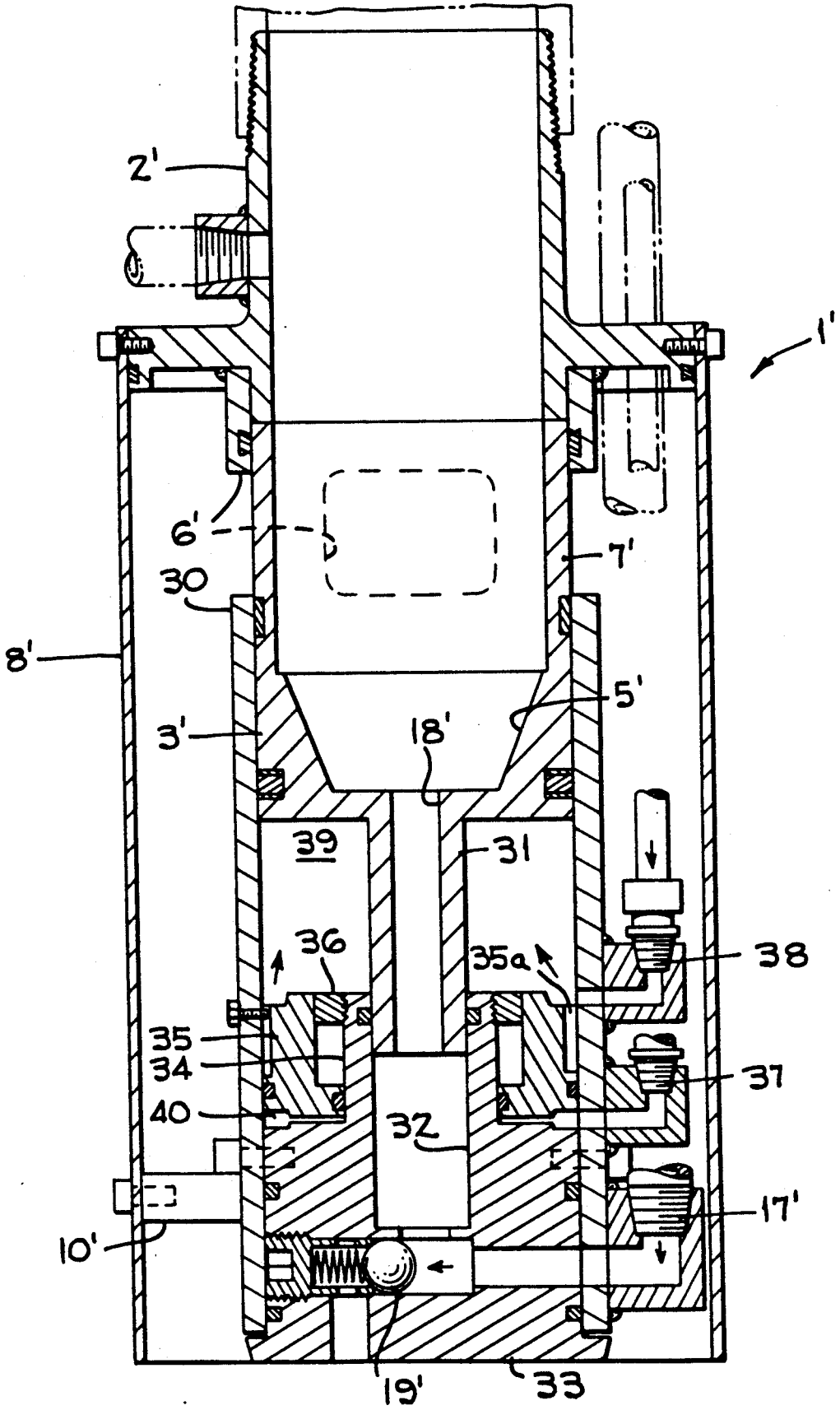
FIG. 6 is a view in axial cross-section of an alternative embodiment of the valve in accordance with the invention shown in the closed configuration.
Figure 7:
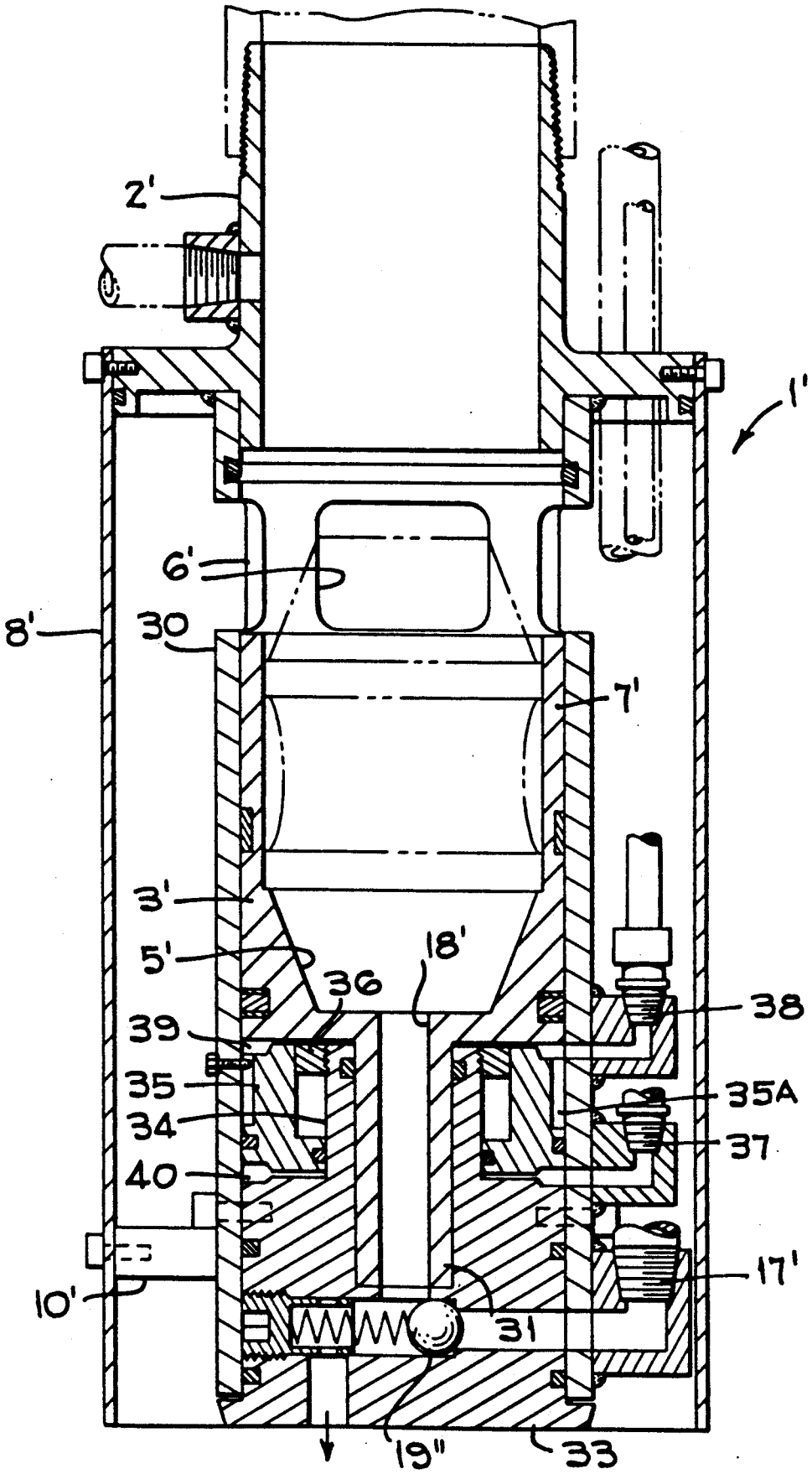
FIG. 7 is an axial view of the valve from FIG. 1 in the open configuration.
Figure 8:
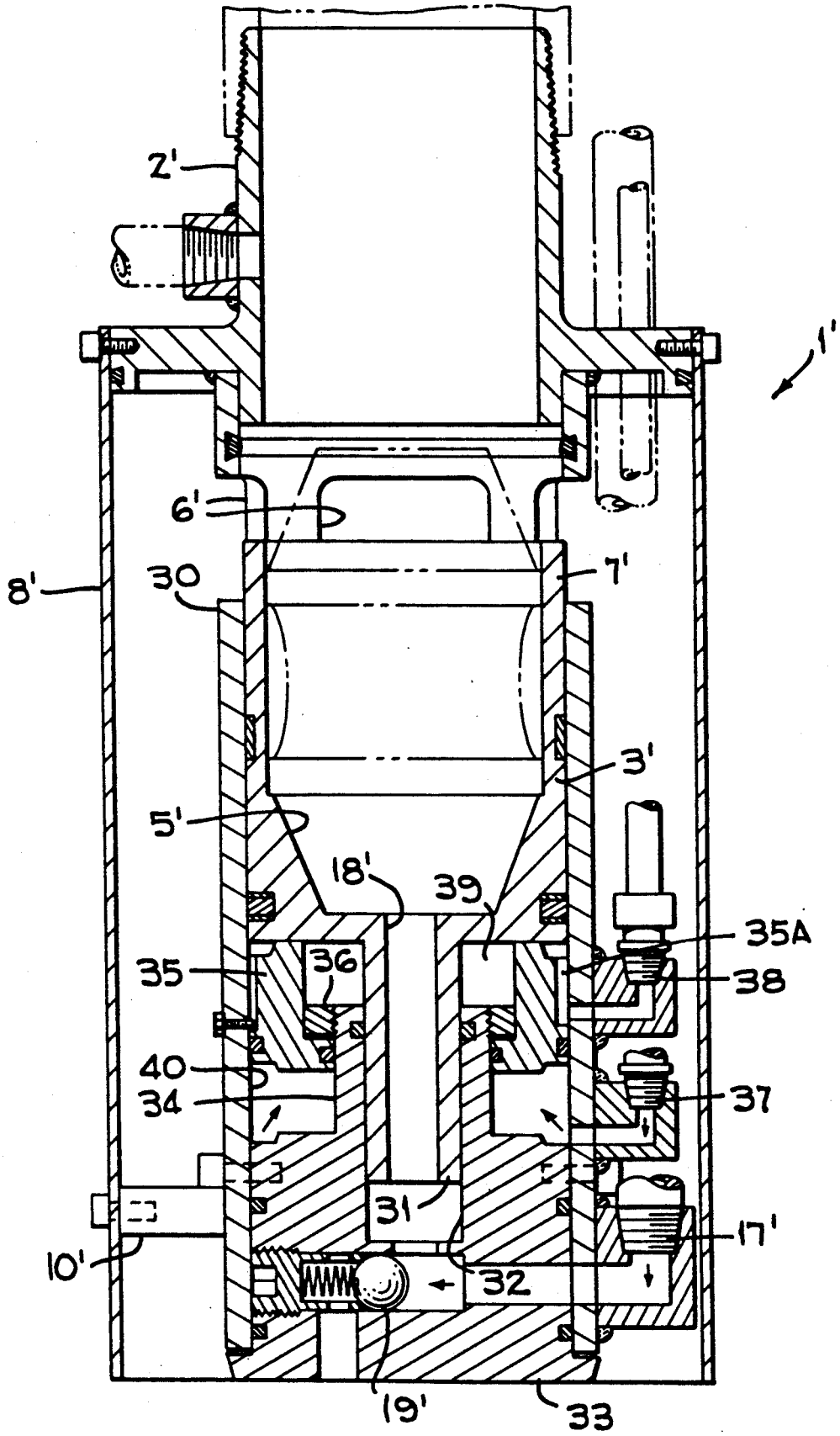
FIG. 8 is an axial view of the valve from FIGS. 6 and 7 in an intermediate closing configuration.

FIGS. 6 through 8 show a valve 1' which differs from that of FIGS. 1 through 5 in that the existence of liquid pressure upstream of the abutment member 3' tends spontaneously to open the annular slot 6' (which is continuous in this embodiment) and so enable flow around the abutment member 31 (this valve is of the failsafe type which automatically opens).

Parts of the valve 1' similar to those of the valve 1 carry the same reference symbols except that they are "primed". The sliding obturator sleeve 7' slides inside a downstream tubular section 30 in which the abutment member 3' slides; the sleeve 7' is an axial extension of the abutment member around the cup 5', the inside diameter of which is equal to the inside diameter of the vertical tube 2' (the inside diameter of the tubular section 30 is therefore greater than that of the vertical tube).

The cylindrical confinement wall 8' is fixed relative to the vertical tube and is held away from the tubular portion 30 by fixed radial fingers 10'.

The abutment member 3' is extended axially in the direction away from the obturator sleeve 7' by a tubular portion 31 of smaller diameter defining a channel 18' discharging into the cup 5'. This tubular portion slides in a liquid-tight way in a cylindrical housing 32 provided in a fixed member 33 fastened to the tubular section 30. The cylindrical housing 32 communicates with a pressurised fluid injection orifice 17' adapted to be connected to a pressure source (not shown). A non-return valve 19' is provided to prevent any flow of liquid from the channel 18' to the orifice 17'.

The fixed member 33 comprises a cylinder 34 flanking the cylindrical housing 32 and along which a ring 35 slides in liquid-tight way radially between the cylinder and the cylindrical section 30. A retaining flange 36 projects radially at the upstream end of the cylinder 34 which prevents the ring 35 escaping beyond the cylinder.

An injection orifice 37 adapted to be connected to a pressure supply is formed through the tubular section 30 in the transverse plane at which the fixed part 33 and the ring 35 meet and a second injection orifice 38 also adapted to be connected to a pressure source is provided in the tubular section 30 further upstream from the orifice 36, so as to discharge upstream of the ring. A groove 35A is provided at the periphery of the ring so hat the orifice 38 remains in communication with the annular space 39 formed between the ring and the abutment member irrespective of the position of the ring.

In the FIG. 6 configuration fluid pressure is injected into the annular space 39 so as to push the abutment member in the upstream direction and so cause the sleeve 7' to close off the annular slot 6' Provided that the resultant upstream thrust is greater than any downstream thrust exerted by a liquid in the vertical tube 2' the valve 1' remains closed.

However, if the pressure in the annular space 39 is deliberately or accidentally removed the abutment 20 member 3' slides in the downstream direction so removing the sleeve 7' from the annular slot 6'. The valve 1' is open (FIG. 7).

If fluid pressure is now injected through the orifice 37 between the fixed member 33 and the ring 35 the ring is raised until it butts against the flange 36 to form an annular space 40 and achieve a predetermined intermediate closing of the slot 6' (FIG. 8).

In an alternative embodiment that is not shown the sleeve 7' is extended further in the upstream direction and openings are provided in the sleeve in such a way that they face the slot 6' in the FIG. 6 configuration and are below it in the FIG. 7 configuration: the same type of fail-safe action is secured as with the valve 1, in other words the pressure of any liquid in the vertical tube 2' tends normally to close the annular slot 6'.

Figure 9:
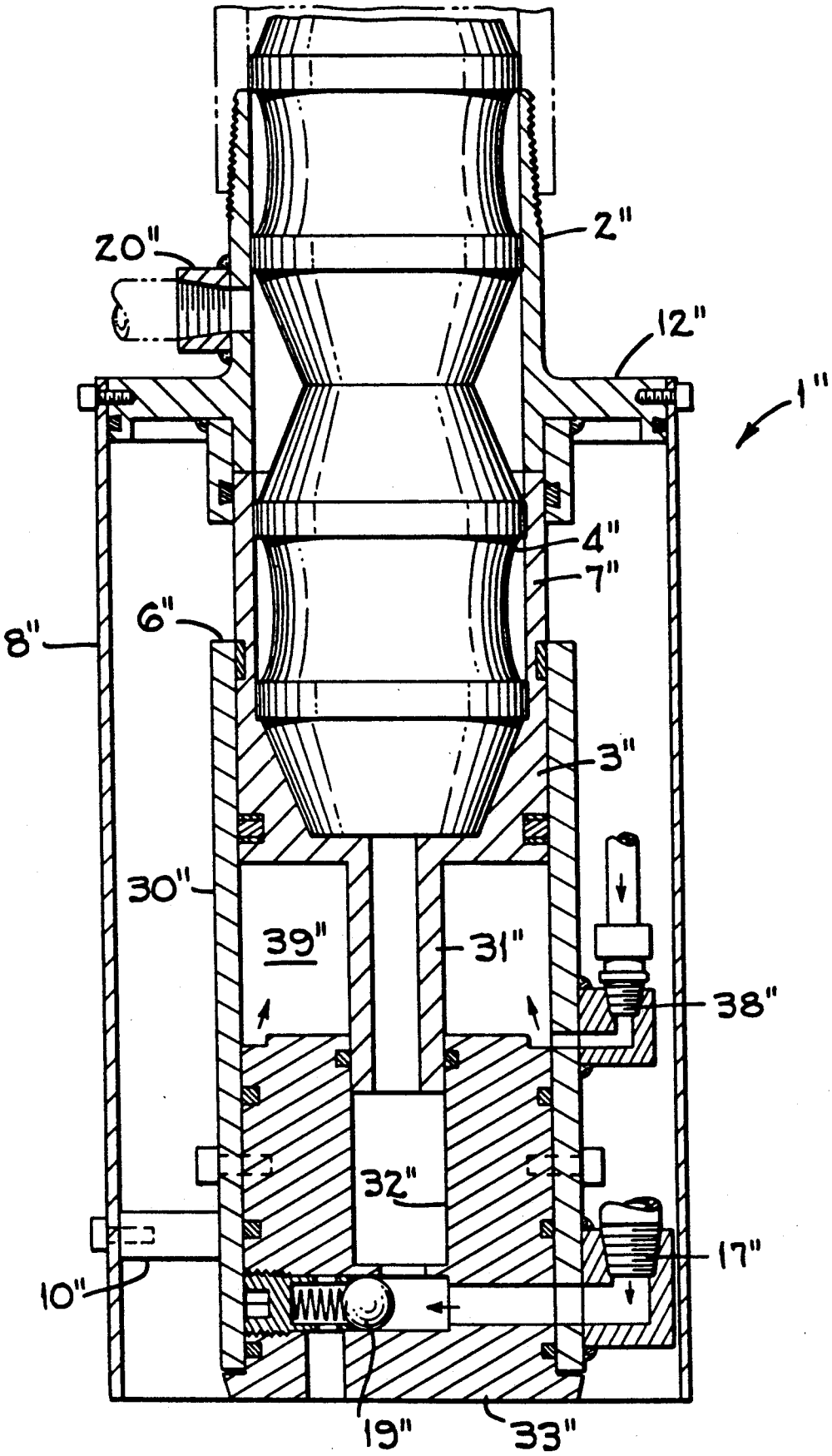
FIG. 9 is an axial view of another embodiment of the valve in accordance with the invention shown in the closed configuration.

FIG. 9 shows a simplified embodiment of the valve 1'. It shows a valve 1'' which differs from the valve 1' in that the ring 35 is eliminated (the other components have the same reference characters except that they are "double-primed"). An intermediate position analogous to that of FIG. 8 is obtained by appropriately choosing the quantity of fluid introduced into the annular space 39'' (this fluid is advantageously a liquid which is incompressible or only slightly compressible, such as oil).

FIGS. 10 through 14 show one example of an application of any of the valves from FIGS. 1 through 9. The valve 1 will be referred to hereinafter, but it is to be understood that the valve 1' or 1'' could be substituted for it.

The valve 1 is fitted to the downstream end of a distribution pipe 50 adapted to be cleaned by scraping and is inserted into the feed orifice 52 of a tanker vehicle 51. The pipe 50 runs from a storage tank (not shown), for example, and incorporates a three-way spherical plug valve 53 (of the kind described in another application filed this day) at the upstream end and in which two scrapers 4 and 4' are normally stored when not in used. The pipe incorporates an articulated section 54 for coupling the downstream section of the pipe 50 to another upstream section connected to another storage tank through another three-way valve (not shown).

Figure 10:
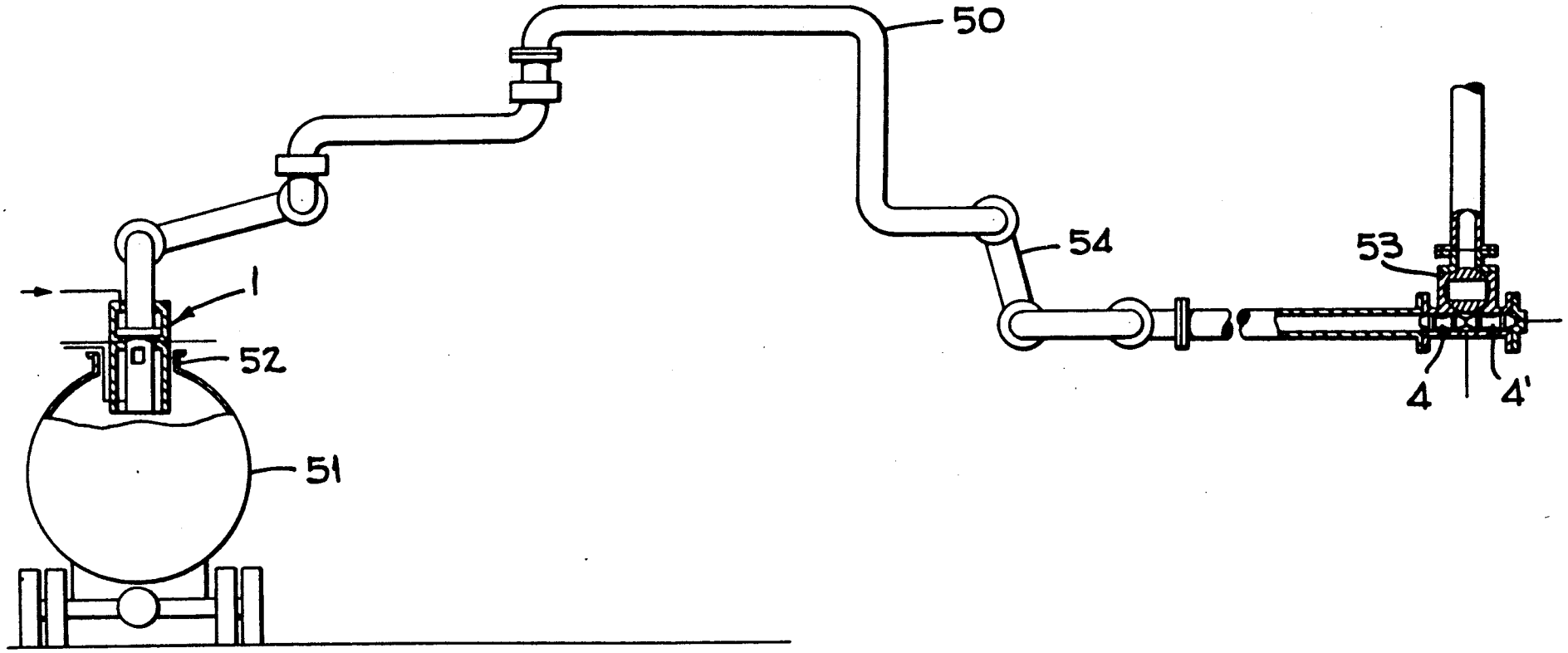
FIGS. 10 through 14 are schematic views of a pipe connecting a storage tank to a tanker vehicle corresponding to five successive phases in the distribution of liquid from the storage tank to the tanker vehicle and the subsequent cleaning by scraping.

In FIG. 10 no liquid flows in the pipe 50 and the two scrapers 4 and 4' are stored in the valve 53 which is closed.

Figure 11:
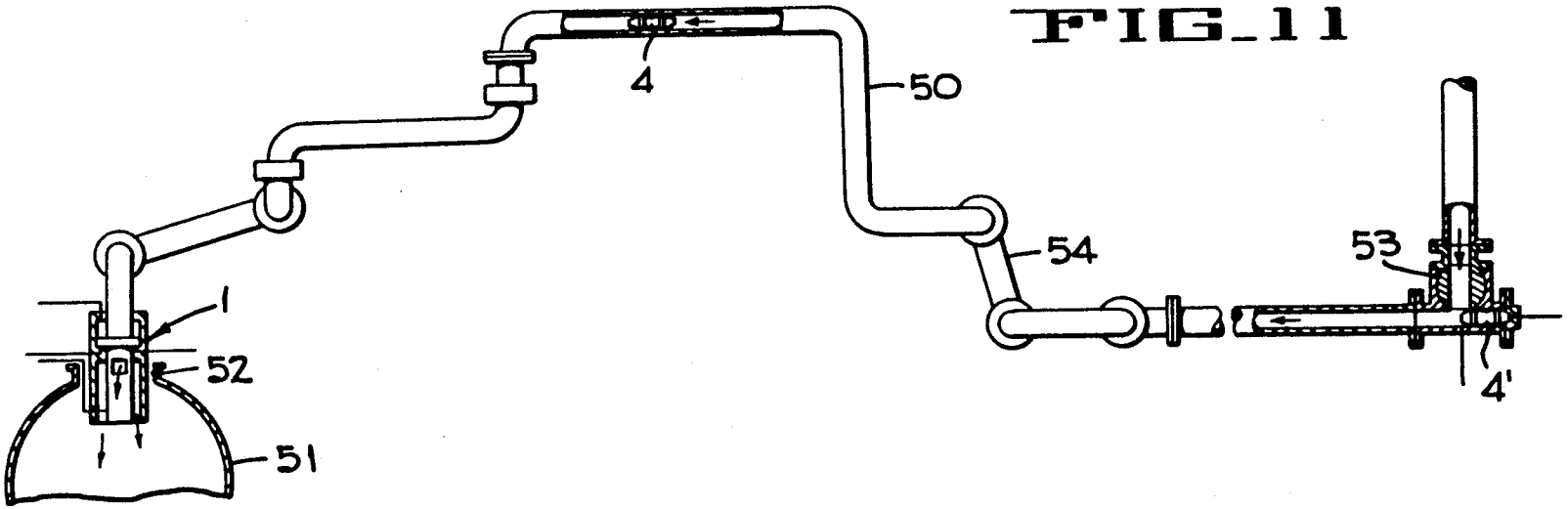

In FIG. 11 the valve 53 has been opened and liquid flows towards the valve 1, propelling the scraper 4 which drives the air in the downstream direction and prevents it mixing with the liquid.

Figure 12:
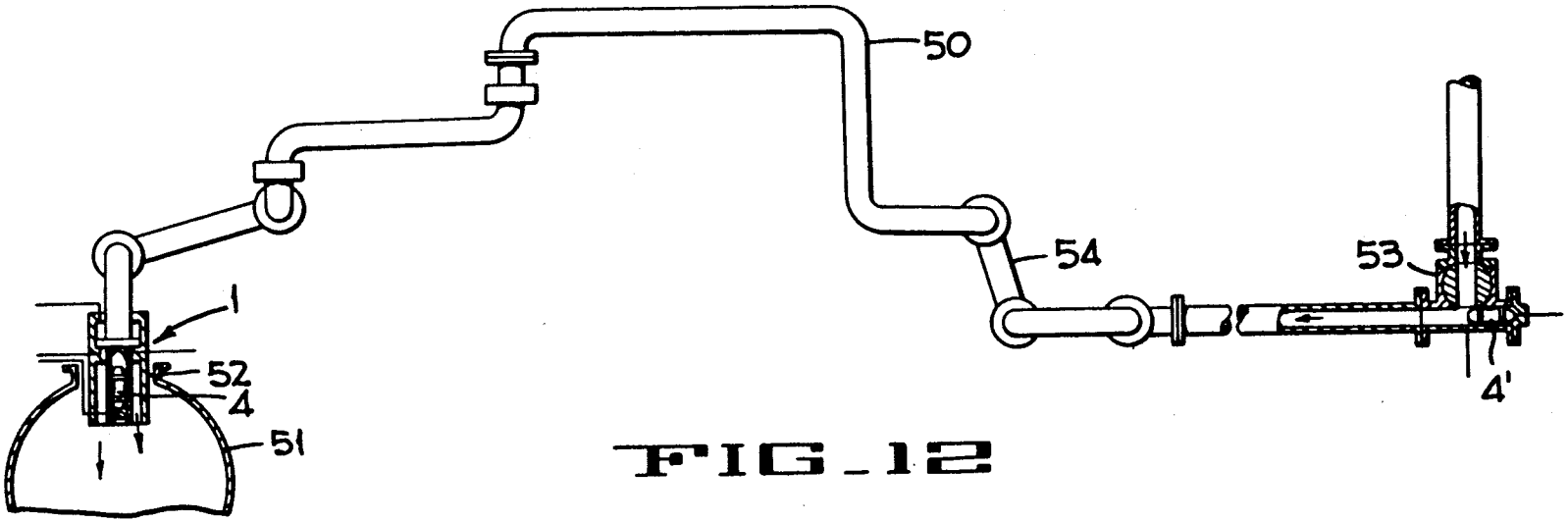
Figure 13:
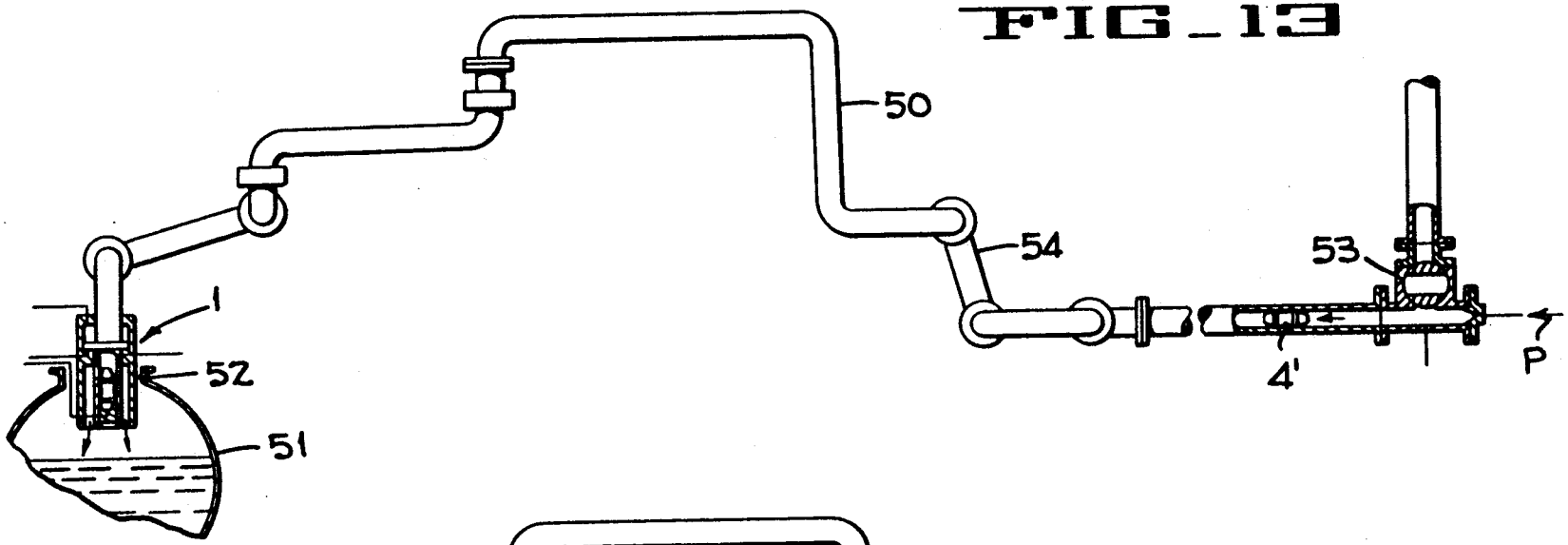
Figure 14:
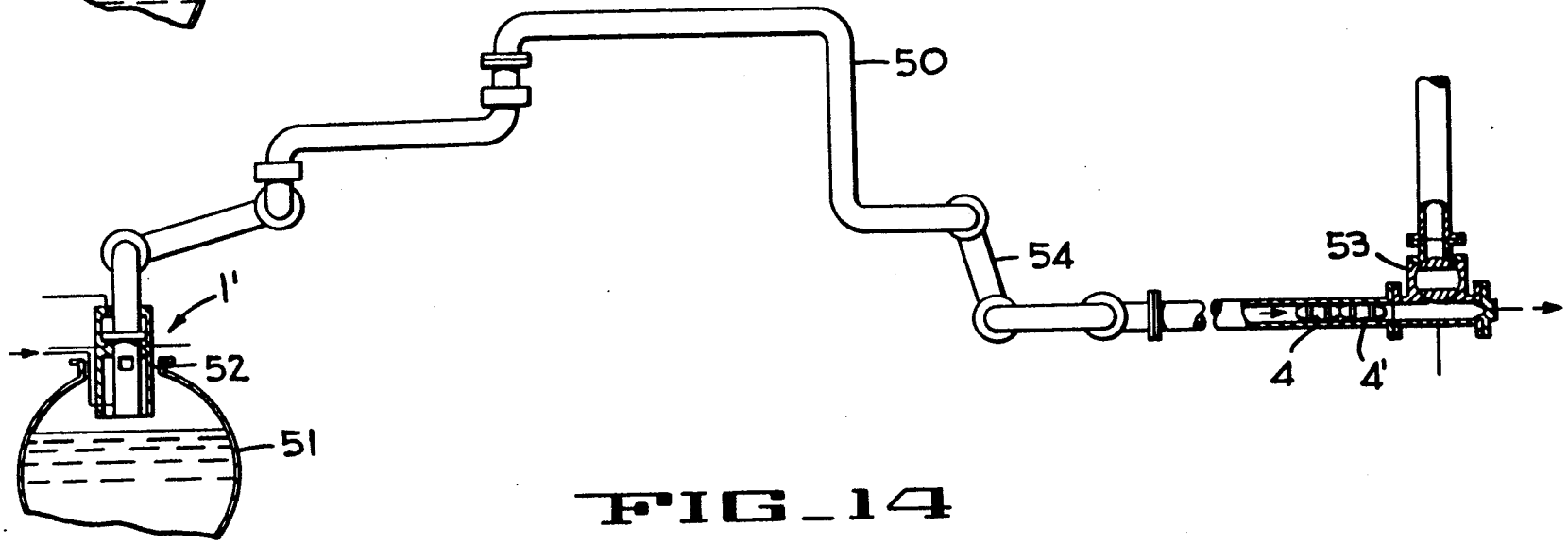

In FIG. 12 the scraper 4 is butted up against the valve 1 which is in the FIG. 1 open configuration so that the liquid flows from the valve into the tanker vehicle which begins to fill.

When the required quantity of liquid has passed through the valve 53 pressure P is applied through the obturator flange of the latter (FIG. 13) to propel the second scraper 4' which therefore scrapes off residues of this liquid. This movement continues until the second scraper butts against the first scraper 4.

Reverse flow pressure is then injected through the orifice 17 (FIG. 1) to return the scrapers 4 and 4' into the valve 53.

The pipe 50 is then ready to distribute another liquid.

It is obvious that the preceding description has been given by way of non-limiting example only and that numerous variations thereon may be proposed by those skilled in the art without departing from the scope of the invention.

I claim:

1. A two-way valve apparatus for a liquid distribution pipe adapted to be cleaned by scraping, said valve comprising:

(a) a tube adapted for connection to the distribution pipe;

(b) a mobile abutment member within the tube and adapted to receive a scraper in abutting relationship therewith after the scraper has traveled along the liquid distribution pipe by a liquid therein and performed a cleaning function;

(c) at least one port in the tube on the upstream side of the abutment member;

(d) a sleeve surrounding the tube and slidably movable longitudinally thereon between a closed position in which the sleeve shuts off the port and an open position in which at least part of the port is exposed;

(e) control means for controlling movement of the sleeve with respect to the tube;

(f) a tubular confinement member surrounding the abutment member, said confinement member fastened to the abutment member and the sleeve so that said members and said sleeve move longitudinally as a unit with respect to the tube; and (g) reverse flow pressure injection means discharging into the abutment member for returning the scraper to its original position within the liquid distribution pipe after the liquid distribution pipe has been cleaned by the scraper; the sleeve, the abutment member and the port longitudinally spaced so that when the sleeve is in its open position the abutment member is both (1) farther upstream than when the sleeve is in its closed position and (2) located a sufficient distance from the port to enable the scraper to come into abutting relationship with the abutment member without closing off the port.

2. A valve according to claim 1 wherein the sleeve is fixed to the confinement member, and the confinement member is joined farther downstream to the abutment member by radial fingers passing through longitudinal slots in the tube.

3. A valve according to claim 1 wherein the confinement member includes an annular flange extending radially into dynamically-sealed contact with the tube upstream of the sleeve, and said tube includes an annular external collar extending radially into dynamically-sealed contact with the confinement member between said flange and said sleeve, said tube, sleeve, collar, flange and confinement member thereby forming two annular fluid-tight chambers separated by said collar, and wherein the control means includes pressurized fluid inlet/outlet orifices communicating with said chambers.

4. A valve according to claim 3 wherein the inlet/-outlet orifices pass through the flange and the sleeve.

5. A valve according to claim 1 wherein the abutment member is cup-shaped and adapted to receive an end portion of a scraper, and wherein the reverse flow pressure injection means includes an orifice in the downstream end of said abutment member.

6. A two-way valve apparatus for a liquid distribution pipe adapted to be cleaned by scraping, said valve comprising:

(a) a tube adapted for connection to the distribution pipe;

(b) a mobile abutment member within the tube and adapted to receive a scraper in abutting relationship therewith after the scraper has traveled along the liquid distribution pipe by a liquid therein and performed a cleaning function;

(c) an annular slot in the tube on the upstream side of the abutment member;

(d) a sleeve slidably positioned inside a downstream section of the tube and movable longitudinally therein between a closed position in which the sleeve shuts off the slot and an open position in which at least part of the slot is exposed, said sleeve forming an upstream oriented extension of the abutment member, said sleeve having an inside diameter commensurate with the inside diameter of the upstream section of the tube so as to enable a scraper to abut the abutment member;

(e) control means for controlling movement of the sleeve with respect to the tube; and (f) reverse flow pressure injection means discharging into the abutment member for returning the scraper to its original position within the liquid distribution pipe after the liquid distribution pipe has been cleaned by the scraper; the sleeve, the abutment member and the slot longitudinally spaced so that when the sleeve is in its open position the abutment member is farther downstream that when the sleeve is in its closed position.

7. A valve according to claim 6 wherein the abutment member includes a tubular portion extending in a downstream direction and defining a fluid flow passage discharging into the downstream end portion of said abutment member, wherein the valve further includes an annular housing for said tubular portion, dynamic sealing means between said housing and said tubular portion, and means communicating said housing with the reverse flow pressure injection means, said housing fastened to a downstream portion of the tube, and wherein the reverse flow pressure injection means includes a first pressurized fluid injection passage discharging into a first chamber downstream of the abutment member.

8. A valve according to claim 7 wherein the housing includes an upstream end portion of reduced outside diameter, and wherein the valve further includes an annular piston surrounding said housing upstream end portion, means dynamically sealing said annular piston to said upstream end portion and the tube thereby defining a second chamber downstream of the first chamber, a second pressurized fluid injection passage discharging into said second chamber, and means for restricting axial movement of said annular piston to predetermined limits.

* * * * *